US010389058B2

(12) United States Patent
Lv

(10) Patent No.: US 10,389,058 B2
(45) Date of Patent: Aug. 20, 2019

(54) ANTI-DROP TYPE HDMI CONNECTOR MALE PLUG

(71) Applicant: Haie Wang, Hubei (CN)

(72) Inventor: Haiyan Lv, Yichang (CN)

(73) Assignee: Haie Wang, Yichang (CN)

( * ) Notice: Subject to any disclaimer, the term of this patent is extended or adjusted under 35 U.S.C. 154(b) by 0 days.

(21) Appl. No.: 15/569,731

(22) PCT Filed: Jan. 11, 2017

(86) PCT No.: PCT/CN2017/070915
§ 371 (c)(1),
(2) Date: Oct. 26, 2017

(87) PCT Pub. No.: WO2018/113054
PCT Pub. Date: Jun. 28, 2018

(65) Prior Publication Data

US 2018/0309224 A1 Oct. 25, 2018

(30) Foreign Application Priority Data

Dec. 23, 2016 (CN) ..... 2016 1 1205547

(51) Int. Cl.
*H01R 13/627* (2006.01)
*H01R 13/502* (2006.01)
(Continued)

(52) U.S. Cl.
CPC ..... *H01R 13/502* (2013.01); *H01R 13/6275* (2013.01); *H01R 13/639* (2013.01);
(Continued)

(58) Field of Classification Search
CPC ..... H01R 13/639; H01R 13/6275
See application file for complete search history.

(56) References Cited

U.S. PATENT DOCUMENTS 7,210,945 B1 * 5/2007 Ying ..... H01R 13/502 439/79
8,002,572 B2 * 8/2011 Lu ..... H01B 7/0892 439/405

(Continued)

FOREIGN PATENT DOCUMENTS

CN 2310395 Y 3/1999
CN 201797168 U 4/2011
CN 204424507 U 6/2015

OTHER PUBLICATIONS

Sep. 27, 2017 Search Report issued in International Patent Application No. PCT/CN2017/070915.

(Continued)

*Primary Examiner* — Xuong M Chung Trans
(74) *Attorney, Agent, or Firm* — Oliff PLC

(57) ABSTRACT

The present invention relates to an anti-drop type HDMI connector male plug. The anti-drop type HDMI connector male plug comprises a shielding housing and an insulating body; and an elastic snap-fit means is arranged in the insulating body. When the anti-drop type HDMI connector male plug is used together with an HDMI connector female socket, after the connector male plug is plugged into the connector female socket, the snap-fit means of the elastic snap-fit means in the connector male plug comes into contact with the inner side wall of the connector female socket to increase a friction force between the male plug and the female socket, thus preventing the male plug from dropping off from the connector female socket and ensuring the reliable transmission of signals.

4 Claims, 6 Drawing Sheets

(51) Int. Cl.

| | |
|---|---|
| ***H01R 13/6591*** | (2011.01) |
| ***H01R 13/639*** | (2006.01) |
| *H01R 12/70* | (2011.01) |
| *H01R 24/60* | (2011.01) |

(52) U.S. Cl.
CPC ..... *H01R 13/6591* (2013.01); *H01R 12/707* (2013.01); *H01R 24/60* (2013.01)

(56) References Cited

U.S. PATENT DOCUMENTS

| | | | | |
|---|---|---|---|---|
| 8,500,489 | B2 * | 8/2013 | Lu | H01B 7/0892 439/607.45 |
| 8,876,558 | B2 * | 11/2014 | Lee | H01R 12/725 439/660 |
| 2009/0081899 | A1 | 3/2009 | Montena | |
| 2009/0203261 | A1 * | 8/2009 | Ikegami | H01R 12/592 439/628 |

OTHER PUBLICATIONS

Sep. 22, 2017 Written Opinion issued in International Patent Application No. PCT/CN2017/070915.

* cited by examiner

ANTI-DROP TYPE HDMI CONNECTOR MALE PLUG

TECHNICAL FIELD

The present invention relates to an anti-drop type HDMI connector male plug.

BACKGROUND ART

In the process of image transmission, when equipment drops off or HDMI cables are tripped by people, it is likely to cause the HDMI connector male to drop off from a female socket, resulting in signal off. Moreover, the solder that is pre-attached to the wire bonding pad of a connection body is liable to fall off, resulting in poor cable contact, and further causing poor signal transmission.

SUMMARY OF THE INVENTION

In view of the above-mentioned drawbacks in the prior art, the technical problem to be solved by the present invention is to provide an anti-drop type HDMI connector male plug to solve the problem that an HDMI connector male plug in the prior art is liable to drop off from the female socket.

To fulfill the above-mentioned purpose, the technical solution of the present invention is implemented in the following way:

An anti-drop type HDMI connector male plug comprises a shielding housing and an insulating body;

wherein receiving grooves are formed inside the shielding housing, and the insulating body is socketed in the receiving grooves;

the insulating body has an elastic snap-fit means which comprises an elastic device and snap-fit means connected with the elastic device; the inner wall of each of receiving grooves is provided with a clamping hole for the corresponding snap-fit means and the corresponding snap-fit means extends out of the clamping hole;

when suffering from a compression force toward the insides of the clamping holes, the snap-fit means retract back in the clamping holes and are also subject to an rebound force applied by the elastic device to the snap-fit means during the retraction; and when the compression force disappears, the rebound force drives the snap-fit means to extend out of the clamping holes again.

Further, the HDMI connector male plug also comprises a terminal assembly and a rear socket, wherein the terminal assembly comprises multiple electroconductive terminals, each of the electroconductive terminals has tow ends, of which one end is socketed in the insulating body and the other end is socketed in the rear socket.

Further, the elastic device comprises a connecting part and two connecting rods, and the number of the snap-fit means is two;

each connecting rod comprises a first sub connecting rod and a second sub connecting rod, and each of the first sub connecting rod and the second sub connecting rod has two ends;

each connecting rod is connected with the connecting part through the first end of the first sub connecting rod of the connecting rod, and is connected with the first end of the second sub connecting rod of the connecting rod through the second end of the first sub connecting rod of the connecting rod; one of the connecting rods is connected with one of the snap-fit means through the second end of its second sub connecting rod, and the other connecting rod is connected with the other snap-fit means through the second end of its second sub connecting rod;

the first sub connecting rods of the two connecting rods are parallel with each other and spaced with a preset distance, and the distance between the first ends of the second sub connecting rods of the two connecting rods is less than the distance between the second ends of the second sub connecting rods of the two connecting rods.

Further, the end, socketed in the rear socket, of each of the electroconductive terminals is provided with a solder slot, a solder hole is formed in and penetrates through the bottom of the solder slot, and the opening, distant away from from the bottom of the solder slot, of the solder hole has a chamfer.

Further, the solder slots are filled with solders.

Compared with the prior art, the anti-drop type HDMI connector male plug provided in the present invention comprises a shielding housing and an insulating body, and an elastic snap-fit means is arranged in the insulating body. When the anti-drop type HDMI connector male plug is used together with an HDMI connector female socket, after the connector male plug is plugged into the connector female socket, the snap-fit means of the elastic snap-fit means in the connector male plug comes into contact with the inner side wall of the connector female socket to increase a friction force between the male plug and the female socket, thus preventing the male plug from dropping off from the connector female socket and ensuring the reliable transmission of signals.

DETAILED DESCRIPTION OF THE INVENTION

Figure 1:
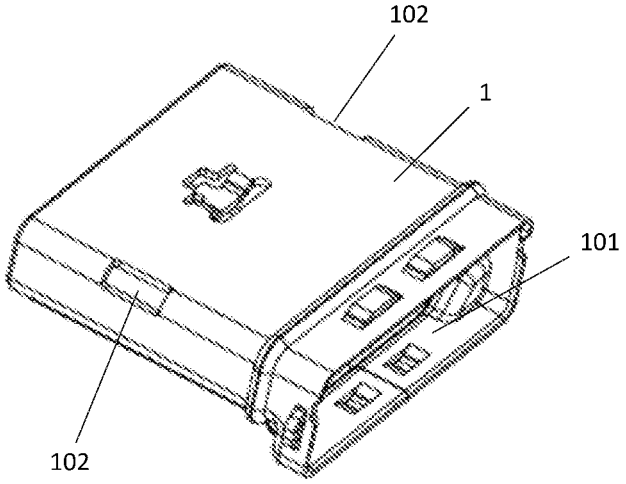
FIG. 1 is a schematic diagram showing the structure of a shielding housing in an anti-drop type HDMI connector male plug provided in an embodiment of the present invention.
Figure 2:
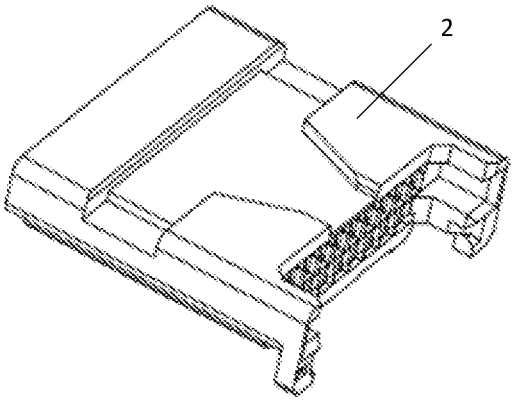
FIG. 2 is a schematic diagram showing the structure of an insulating body in an anti-drop type HDMI connector male plug provided in an embodiment of the present invention.
Figure 3:
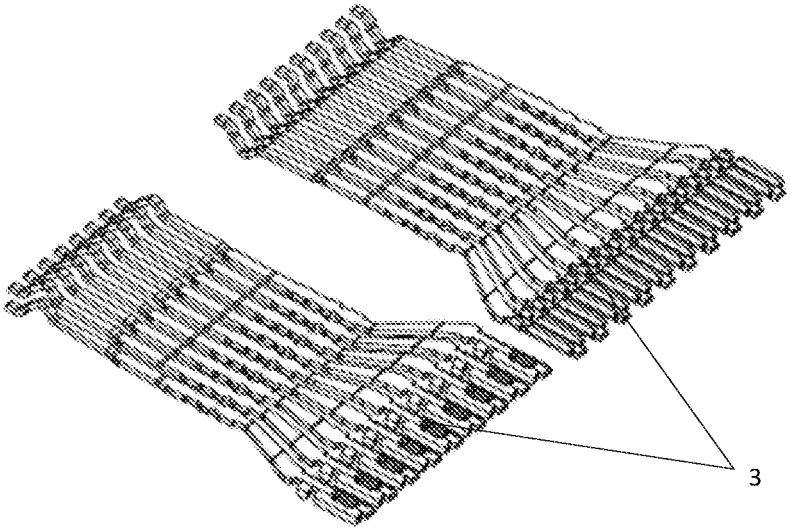
FIG. 3 is a schematic diagram showing the structure of a terminal assembly in an anti-drop type HDMI connector male plug provided in an embodiment of the present invention.
Figure 4:
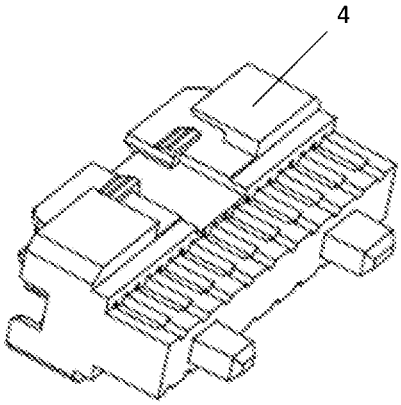
FIG. 4 is a schematic diagram showing the structure of a rear socket in an anti-drop type HDMI connector male plug provided in an embodiment of the present invention.

The technical solutions in embodiments of the present invention will be described clearly and completely hereinafter with reference to the accompanying drawings in the embodiments of the present invention. Apparently, embodiments described her are merely part, not all of embodiments of the present invention. The components in embodiments of the present invention, which are typically described and illustrated herein in the drawings, may be arranged and designed in a variety of different configurations. Accordingly, the following detailed description of the embodiments of the present invention provided in the drawings is not intended to limit the scope of the present invention claimed, but merely to explain the selected embodiments of the present invention. According to the embodiments in the present invention, all other embodiments obtained by those of ordinary skill in the art without doing any creative work fall within the scope of the present invention.

In the description of the present invention, it should also be noted that the term "connected" should be broadly understood, unless otherwise expressly specified and defined, for example, it may refer to "fixedly connected", and may also refer to "detachably connected", or "integrally connected"; it may refer to "mechanically connected" and may also refer to "electrically connected"; it may refer to "directly connected", may also refer to "indirectly connected through an intermediate, and may further refer to the internal connectivity of two elements. For those skilled in the art, the specific meanings of the above term in the present invention could be understood according to the specific conditions.

Referring to FIGS. 1-4, an embodiment of the present invention provides an anti-drop type HDMI connector male plug, comprising a shielding housing 1, an insulating body 2, a terminal assembly 3 and a rear socket 4.

Figure 9:
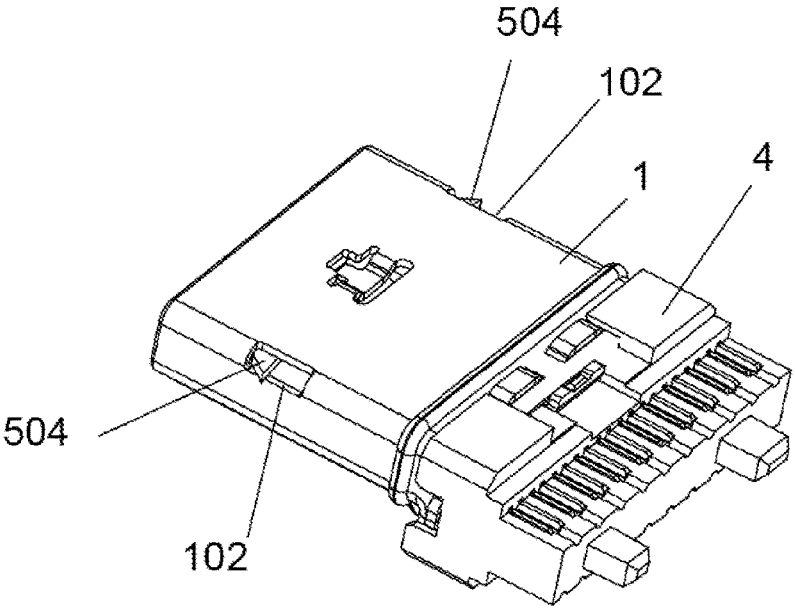
FIG. 9 is a schematic diagram showing the insulating body, the terminal assembly, the rear socket, the elastic snap-fit means and the shielding housing.

Referring to FIGS. 1 and 9, receiving grooves are formed inside the shielding housing 1 and the insulating body 2 is socketed in the receiving grooves.

Figure 5:
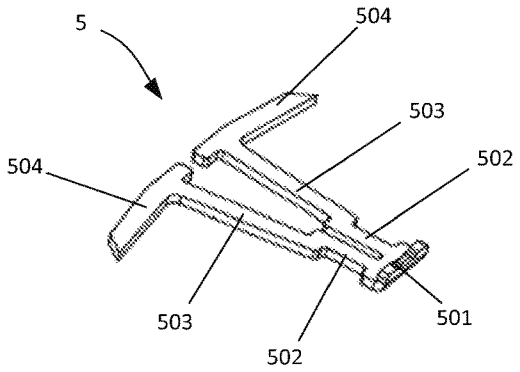
FIG. 5 is a schematic diagram showing the structure of an elastic snap-fit means in an anti-drop type HDMI connector male plug provided in an embodiment of the present invention.
Figure 6:
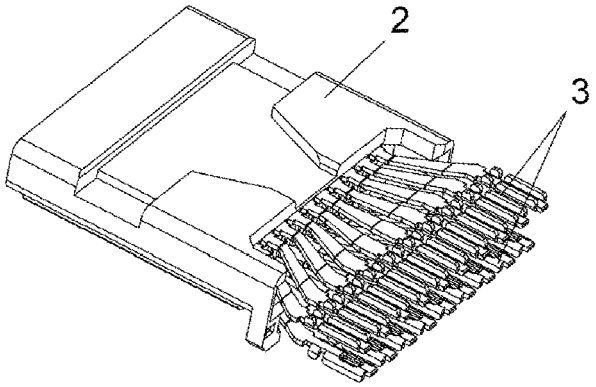
FIG. 6 is a schematic diagram showing the combination of the terminal assembly and the insulating body.

The insulating body 2 has an elastic snap-fit means 5. Referring to FIG. 5, the elastic snap-fit means 5 comprises an elastic device and snap-fit means 504 connected with the elastic device. Referring to FIGS. 1 and 9, the inner wall of each of receiving grooves is provided with a clamping hole 102 for the corresponding snap-fit means 504 and the snap-fit means 504 extend out of the clamping holes 102. In FIG. 9, only the snap-fit means 504 of the elastic snap-fit means 5 are exposed out of the insulating body 2.

when suffering from a compression force toward the insides of the clamping holes 102, the snap-fit means 504 can retract back in the clamping holes 102 and are also subject to an rebound force applied by the elastic device to the snap-fit means 504 during the retraction; and when the compression force disappears, the rebound force drives the snap-fit means 504 to extend out of the clamping holes 102 again.

Figure 7:
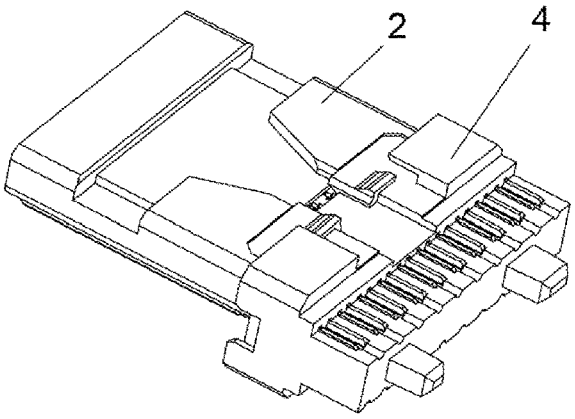
FIG. 7 is a schematic diagram showing the combination of the insulating body, the terminal assembly and the rear socket.
Figure 8:
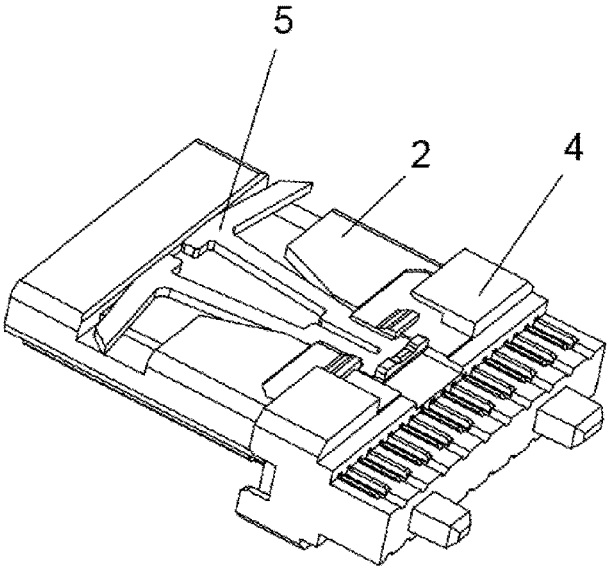
FIG. 8 is a schematic diagram showing the combination of the insulating body, the terminal assembly, the rear socket and the elastic snap-fit means.

Due to the elastic snap-fit means 5, the insulating body 2 can be firmly socketed in the receiving grooves of the insulating housing 1 and hardly drops off. Further, the assembled anti-drop type HDMI connector male plug can be firmly socketed in an HDMI connector female socket; when the anti-drop type HDMI connector male plug is connected with the HDMI connector female socket, after the connector male plug is plugged into the connector female socket, the snap-fit means 504 of the elastic snap-fit means 5 in the connector male plug comes into contact with the inner side wall of the connector female socket to increase a friction force between the male plug and the female socket, thus preventing the male plug from dropping off from the connector female socket and ensuring the reliable transmission of signals. Referring to FIGS. 3, 6, 7 and 8, the terminal assembly 3 has multiple electroconductive terminals. Each electroconductive terminal has two ends, of which one is socketed in the insulating body 2 and the other end is socketed in the rear socket 4. In FIGS. 7 and 8, the electroconductive terminals are blocked and therefore cannot be seen.

As shown in FIG. 5, the elastic device comprises a connecting part 501 and two connecting rods, and the number of the snap-fit means 504 is two. each connecting rod comprises a first sub connecting rod 502 and a second sub connecting rod 503, and each of the first sub connecting rod 502 and the second sub connecting rod 503 has two ends. each connecting rod is connected with the connecting part 501 through the first end of the first sub connecting rod 502 of the connecting rod, and is connected with the first end of the second sub connecting rod 503 of the connecting rod through the second end of the first sub connecting rod 502 of the connecting rod; one of the connecting rods is connected with one of the snap-fit means 504 through the second end of its second sub connecting rod 503, and the other connecting rod is connected with the other snap-fit means 504 through the second end of its second sub connecting rod 503. the first sub connecting rods 502 of the two connecting rods are parallel with each other and spaced with a preset distance, and the distance between the first ends of the second sub connecting rods 503 of the two connecting rods is less than the distance between the second ends of the second sub connecting rods 503 of the two connecting rods. The elastic device is made of a material having certain deformation and rebound elasticity, such as plastics. This shape structure allows the snap-fit means 5 to be elastic somehow; during the insertion of the insulating body 2 into the shielding housing 1, the two snap-fit means 504 are compressed by the inner wall of the receiving grooves of the shielding housing 1 to get close to each other, so that the insulating body 2 can be successfully inserted into the shielding housing 1; and during the insertion of the assembled anti-drop-type HDMI connector male plug into an HDMI connector female socket, the two snap-fit means 504 will also be compressed by the inner wall of the female socket to get close to each other, so that the anti-drop-type HDMI connector male plug can be successfully inserted into the HDMI connector female socket; and when the anti-drop-type HDMI connector male plug is plugged into the connector female socket, the two snap-fit means 504 generates friction with the inner wall of the connector female socket to increase the friction force between the male plug and the female socket, so that the connector male plug hardly drops off from the female socket, thus ensuring the reliable signal transmission.

Figure 10:
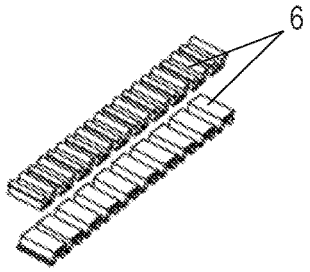
FIG. 10 is a schematic diagram showing the structure of solder.
Figure 11:
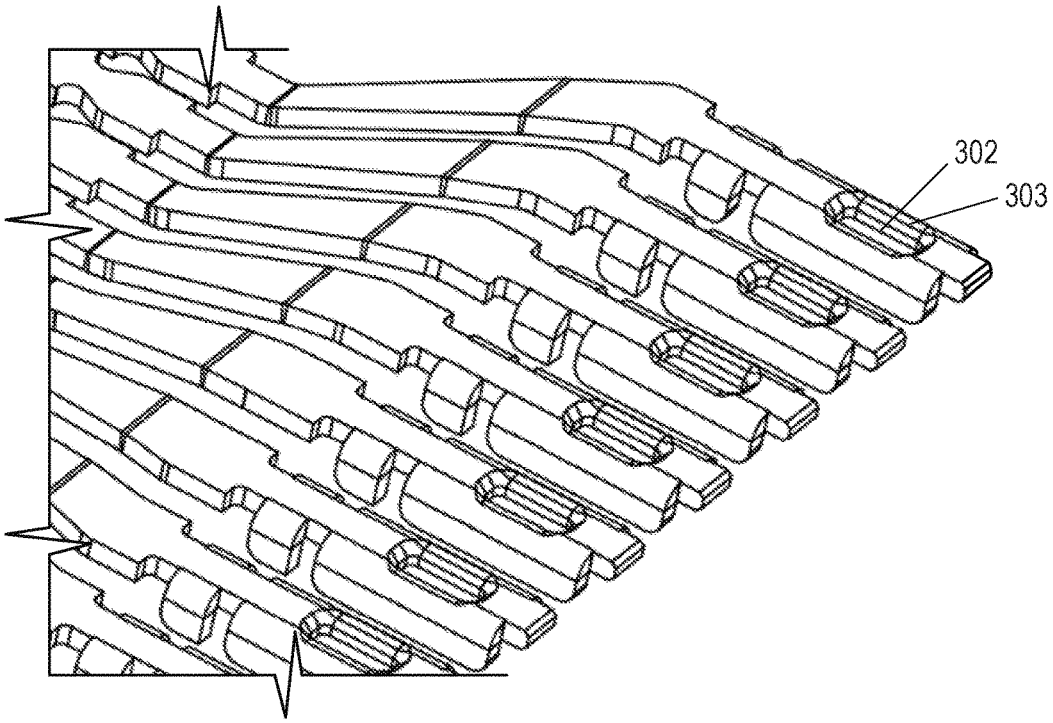
FIG. 11 is a front view of the end, socketed in the rear socket, of a electroconductive terminal.
Figure 12:
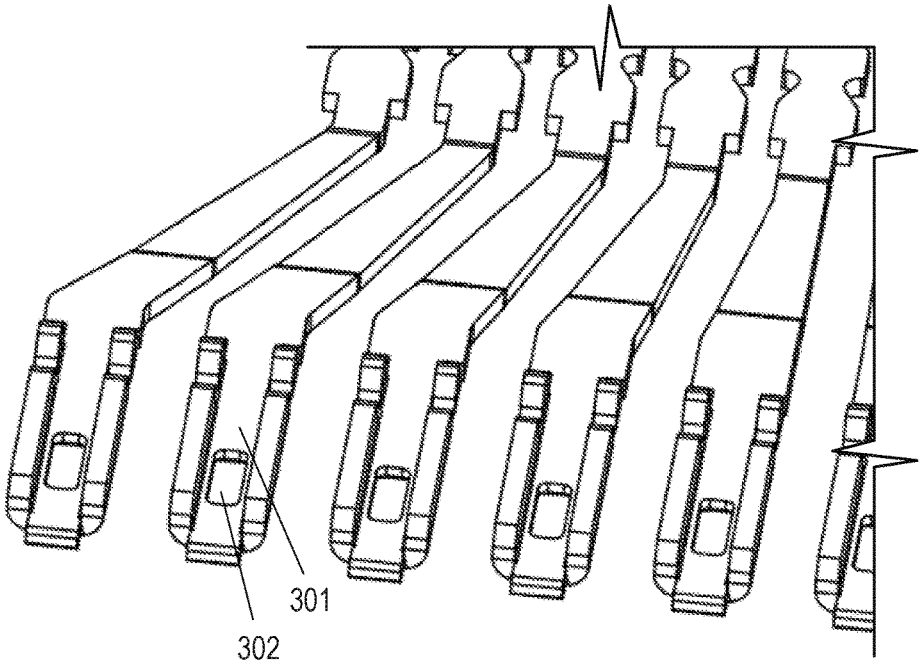
FIG. 12 is a back view of the end, socketed in the rear socket, of a electroconductive terminal.

As shown in FIG. 11, the end, socketed in the rear socket 4, of each of the electroconductive terminals is provided with a solder slot 301, a solder hole 302 is formed in and penetrates through the bottom of the solder slot 301. As shown in 12, the opening, distant away from from the bottom of the solder slot 301, of the solder hole 302 (i.e., the opening in the back of the end, socketed in the rear socket 4, of the electroconductive terminal) has a chamfer 303. The solder slots 301 are filled with solders 6. FIG. 10 shows the solders 6. During welding, the solders 6 in the solder slots 301 is melted and flows into the solder holes 302 to reach the chambers 303 of the solder holes 302. After the solders 6 is cooled and solidified, the effect similar to riveting with a rivet is achieved and therefore the solders 6 hardly drops off. In FIG. 8, the terminal assembly 3 is blocked by the solders 6 and therefore cannot be seen.

Finally, it should be noted that the above embodiments are only used for illustrating rather than limiting the technical solutions of the present disclosure. Although the present disclosure is described in detail with reference to the foregoing embodiments, those of ordinary skill in the art should understand that they still can make modifications to the technical solutions disclosed in the foregoing embodiments or make equivalent substitutions to part or all of technical features thereof; and such modifications or substitutions should not cause the essence of the corresponding technical solutions to depart from the scope of the technical solutions of the embodiments of the present disclosure.

The invention claimed is:

1. An anti-drop type HDMI connector male plug, comprising a shielding housing and an insulating body;

wherein receiving grooves are formed inside the shielding housing, and the insulating body is socketed in the receiving grooves;

the insulating body has an elastic snap-fit means, which comprises an elastic device and snap-fit means connected with the elastic device; the inner wall of each of receiving grooves is provided with a clamping hole for the corresponding snap-fit means and the corresponding snap-fit means extends out of the clamping holes;

when suffering from a compression force toward the insides of the clamping holes, the snap-fit means retract back into the clamping holes and are also subject to a rebound force applied by the elastic device to the snap-fit means during the retraction; and when the compression force disappears, the rebound force drives the snap-fit means to extend out of the clamping holes again;

the elastic device comprises a connecting part and two connecting rods, and the number of the snap-fit means is two;

each connecting rod comprises a first sub connecting rod and a second sub connecting rod, and each of the first sub connecting rod and the second sub connecting rod has two ends; each connecting rod is connected with the connecting part through the first end of the first sub connecting rod of the connecting rod, and is connected with the first end of the second sub connecting rod of the connecting rod through the second end of the first sub connecting rod of the connecting rod; one of the connecting rods is connected with one of the snap-fit means through the second end of its second sub connecting rod, and the other connecting rod is connected with the other snap-fit means through the second end of its second sub connecting rod; and the first sub connecting rods of the two connecting rods are parallel with each other and spaced with a preset distance, and the distance between the first ends of the second sub connecting rods of the two connecting rods is less than the distance between the second ends of the second sub connecting rods of the two connecting rods.

2. The anti-drop type HDMI connector male plug according to claim 1, further comprising a terminal assembly and a rear socket, wherein the terminal assembly has multiple electroconductive terminals, each of the electroconductive terminals has two ends, of which one end is socketed in the insulating body and the other end is socketed in the rear socket.

3. The anti-drop type HDMI connector male plug according to claim 2, wherein the end, socketed in the rear socket, of each of the electroconductive terminals is provided with a solder slot, a solder hole is formed in and penetrates through the bottom of the solder slot, and the opening, distant away from the bottom of the solder slot, has a chamfer.

4. The anti-drop type HDMI connector male plug according to claim 3, wherein the solder slots are filled with solders.

* * * * *